US006398221B1

(12) United States Patent
Graham

(10) Patent No.: US 6,398,221 B1
(45) Date of Patent: Jun. 4, 2002

(54) POLYHEDRON GLOBE PUZZLE SYSTEM

(76) Inventor: John Alexander Graham, 29 Whitehall Park, Flat B, London N19 3TS (GB)

( * ) Notice: Subject to any disclaimer, the term of this patent is extended or adjusted under 35 U.S.C. 154(b) by 0 days.

(21) Appl. No.: 09/614,247

(22) Filed: Jul. 12, 2000

Related U.S. Application Data

(63) Continuation-in-part of application No. 09/304,282, filed on May 3, 1999, now abandoned.

(30) Foreign Application Priority Data

May 15, 1998 (GB) ..... 2074733

(51) Int. Cl.[7] ..... A63F 9/12

(52) U.S. Cl. ..... 273/157 R; 434/135; 434/137; 446/111

(58) Field of Search ..... 273/153 R, 155, 273/156, 157 R, 153 S; 434/131, 132, 134, 135, 137, 146; 446/105, 108, 111, 112, 115, 119, 122, 126

(56) References Cited

U.S. PATENT DOCUMENTS 1,081,207 A * 12/1913 Cahill
2,424,601 A * 7/1947 Crouch
3,578,331 A * 5/1971 DeGast
3,691,704 A * 9/1972 Novak
4,377,286 A * 3/1983 Constantinescu
4,441,715 A * 4/1984 Titus
4,473,228 A * 9/1984 Hart
4,478,418 A * 10/1984 Sherman
4,529,201 A * 7/1985 Nadel
5,217,226 A * 6/1993 Christopher
6,068,533 A * 5/2000 Glickman et al.
6,158,740 A * 12/2000 Hall
6,186,855 B1 * 2/2001 Bauer et al.

* cited by examiner

*Primary Examiner*—William M. Pierce
(74) *Attorney, Agent, or Firm*—Ourpal Asija

(57) ABSTRACT

The polyhedron globe puzzle system of this invention comprises a plurality of scalene triangles with attachment means so as to form a generally spherical body on which is inscribed a world map such that the position of the scalene triangles contains latent and patent information and intelligence about the geography of the world map including but not limited to longitudinal and latitudinal information. The 360 edges of the 240'dron form themselves into 21 circumscribing polygons which, when projected on to a concentric true sphere, become Great Circles.

1 Claim, 5 Drawing Sheets

POLYHEDRON GLOBE PUZZLE SYSTEM

RELATED DOCUMENT

Figure 1:
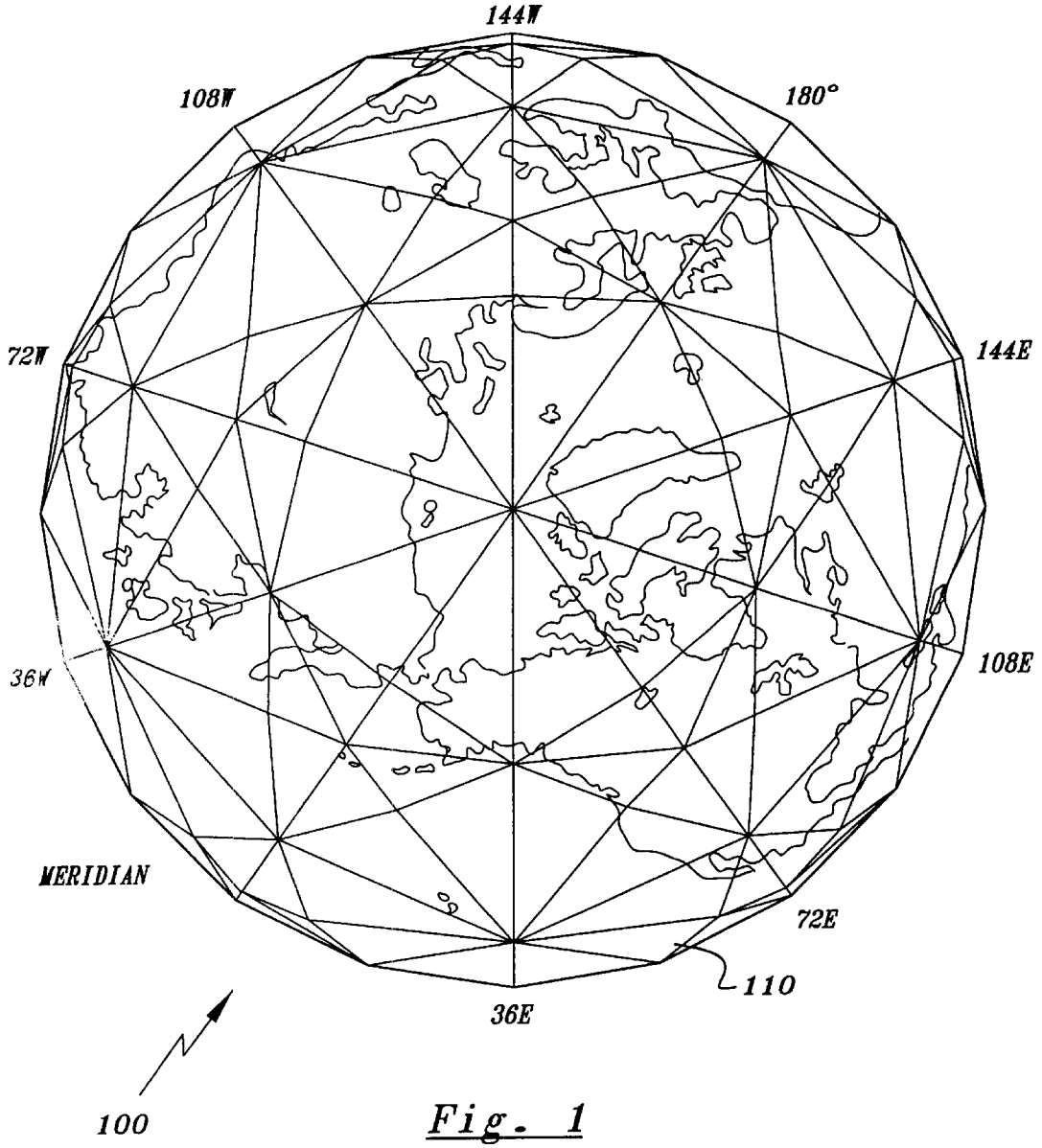

This application is a Continuation-In-Part application to Ser. No. 09/304,282 filed May 3, 1999 now abandoned.

BACKGROUND

This invention relates to methods, device and systems for educational and entertaining puzzles. More particularly it relates to a global polyhedron puzzle comprising plurality of triangles.

THE PROBLEM

The problems with prior art polyhedron puzzles is that they have very limited if any educational value. They are not particularly entertaining. Their construction is not modular, design is not elegant and are often not even affordable. For the similar reasons they are not cost effective.

SUMMARY

The polyhedron globe puzzle system of this invention comprises a plurality of triangles with attachment means so as to form a generally spherical body.

An embodiment of this invention is inscribed a world map such that the position of the triangular pieces contains latent and patent information and intelligence about the geography of the world map including but not limited to longitudinal and latitudinal information because the edges of the triangles form the "Great Circle".

PRIOR ART

A preliminary prior art patentability and novelty search was commissioned. Furthermore the inventor is intimately familiar with the prior art. Following are examples of the prior art discovered in the search and/or known to the applicant/inventor and/or his patent agent/attorney. The following prior art has been arranged in the reverse chronological order for ready reference of the reader.

a) U.S. Utility Pat. No. 5,842,697 awarded to Scott et al on Dec. 1, 1998 for "Polyhedral Surface Jigsaw Puzzles"

b) U.S. Utility Pat. No. 5,722,657 granted to Dario Cabrera of Bogota Columbia on Mar. 3, 1998 for "Irregular Polyhedron Puzzle Game with Pieces of Asymmetric Shapes"

c) U.S. Utility Pat. No. 5,660,387 bestowed upon William Stokes on Aug. 26, 1997 for "Polyhedron Puzzle"

d) U.S. Utility Pat. No. 5,538,452 earned by Nadim Kurani on Jul. 23, 1996 for "Puzzle Toy with Hinge-Linked Members"

e) U.S. Utility Pat. No. 5,344,148 published in the name of Sabine Asch of Germany for "Three dimensional puzzle"

f) U.S. Utility Patent blessed upon Abu-Shumays et al on Nov. 17, 1987 for "Regular Polyhedron Puzzles"

g) U.S. Utility Pat. No. 4,558,866 honorably given to William Alford on Dec. 17, 1985 for "Regular Polyhedron-Based Logical Puzzles"

h) U.S. Utility Pat. No. 4,529,201 honorably issued to Ernest Nadel on Jul. 16, 1985 for "Multi-Faceted Solid Geometrical Puzzle Toy"

i) U.S. Utility Pat. No. 4,500,090 patented by Antoliano Nieto of Canada on Feb. 19, 1985 for "Polyhedral Puzzle"

j) U.S. Utility Pat. No. 4,483,535 bestowed upon Jean-Guy LeCart of France on Nov. 20, 1984 for "Triangle Combination Game"

k) U.S. Utility Pat. No. 4,456,258 honored upon Lawrence Lodrick on Jun. 26, 1984 for "Game with an Icosahedral Geodesic Sphere Board"

l) U.S. Utility Pat. No. 4,453,715 earned by Benjamin Halpern on Jun. 12, 1984 for "Three-Dimensional Puzzle"

m) U.S. Utility Pat. No. 4,345,761 given to David China on Aug. 24, 1982 for "Tetrahedral Gaming Die with Recessed Pyramidal faces"

n) U.S. Utility Pat. No. 4,153,254 bestowed upon Michel Marc on May 8, 1979 for "Puzzle"

Unfortunately none of the prior art devices singly or even in combination provide all of the features and objectives established by the inventor for this system as enumerated below.

OBJECTIVES

1. It is an objective of this invention to provide method, devices and system for an entertaining and educational polyhedron puzzle system.

2. Another objective of this invention is to provide a globe puzzle wherein the position of the various components conveys additional information.

3. Another objective of this invention is that it use little or no additional power or energy.

4. Another objective of this invention is that it is easy to use even intuitive that requires little additional training.

5. Another objective of this invention is that the system of this invention be suitable for teaching a variety of subjects including but not limited to geography, geometry, art, world history, science and related arts and sciences.

6. Another objective of this invention is that it be physically safe in normal environment as well as accidental situations.

7. Another objective of this invention is that it be environmentally friendly.

8. Another objective of this invention is that it be made of modular units easily interface-able to each other.

9. Another objective of this invention is that it meet all federal, state, local and other private standards, guidelines and recommendations with respect to safety, environment, quality and energy consumption.

10. Another objective of this invention is that it appeal to students and people of all ages, gender, cultures, nations and races etc.

11. Another objective of this invention is that it be elegantly simple in concept and design.

12. Another objective of this invention is that it be enjoyable such that education is fun.

13. Another objective of this invention is that it be easy to assemble, disassemble, transport and store.

14. Another objective of this invention is that it be useable in all types of locations including home, schools, work and transportation etc.

15. Another objective of this invention is that it be entertaining in its own right.

16. Another objective of this invention is that it can be adapted for other uses.

17. Another objective of this invention is that it develop a competitive spirit against one's own performance as well as again the performance of others.

18. Another objective of this invention is that it be colorful and aesthetic.

19. Another objective of this invention is that the polyhedron of this invention span a wide range of sides and surfaces.

20. Another objective of this invention is that the puzzle of this invention may be assembled and dismantled, starting and finishing with any piece.

21. Another objective of this invention is that during and on completion of assembly the polyhedron remain free standing without the need for any supporting structure external or internal.

Other objectives of this invention reside in its simplicity, elegance of design, ease of manufacture, service and use and even aesthetics as will become apparent from the following brief description of the drawings and concomitant description.

Figure 2:
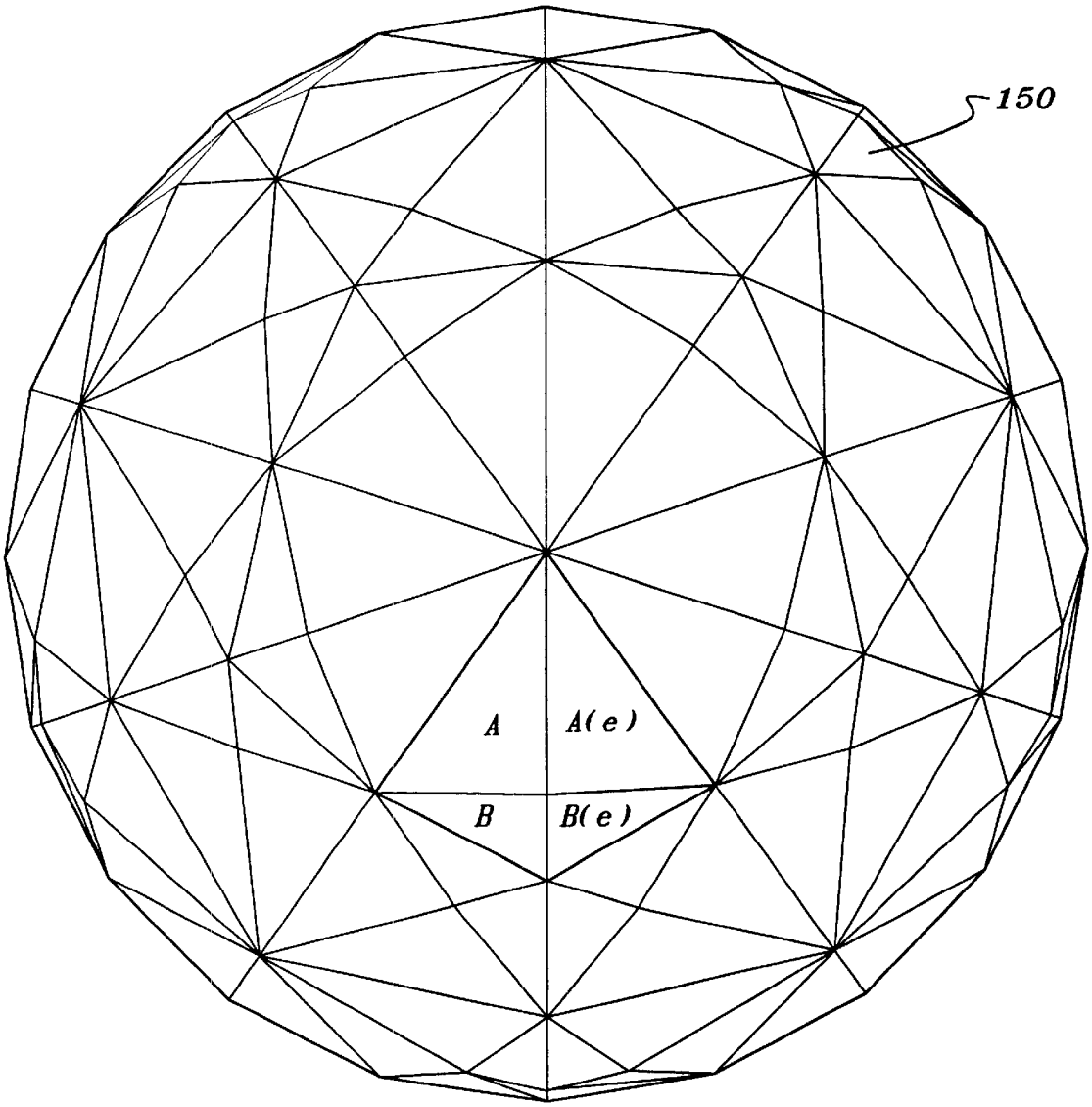
Figure 3:
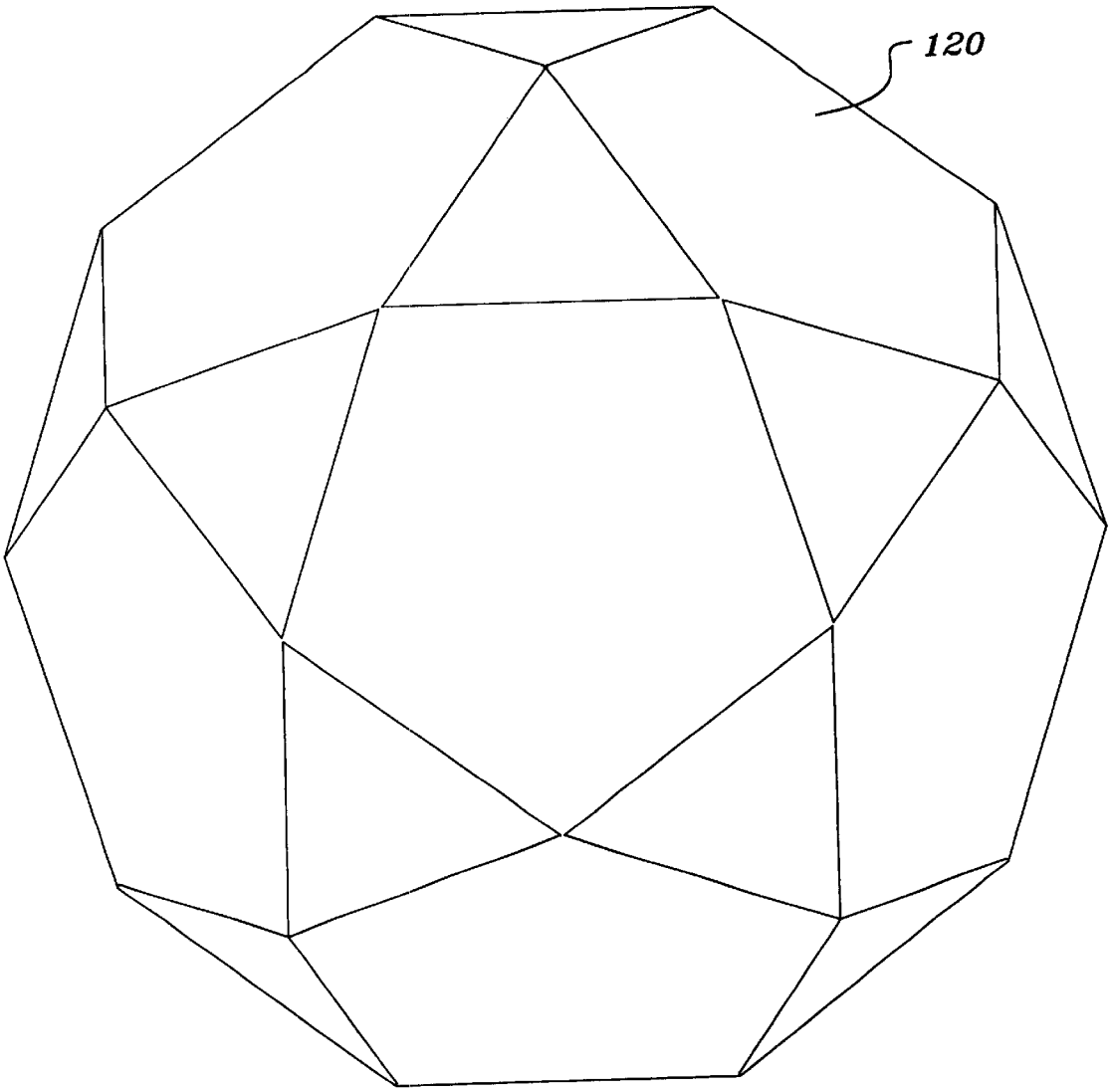
Figure 4:
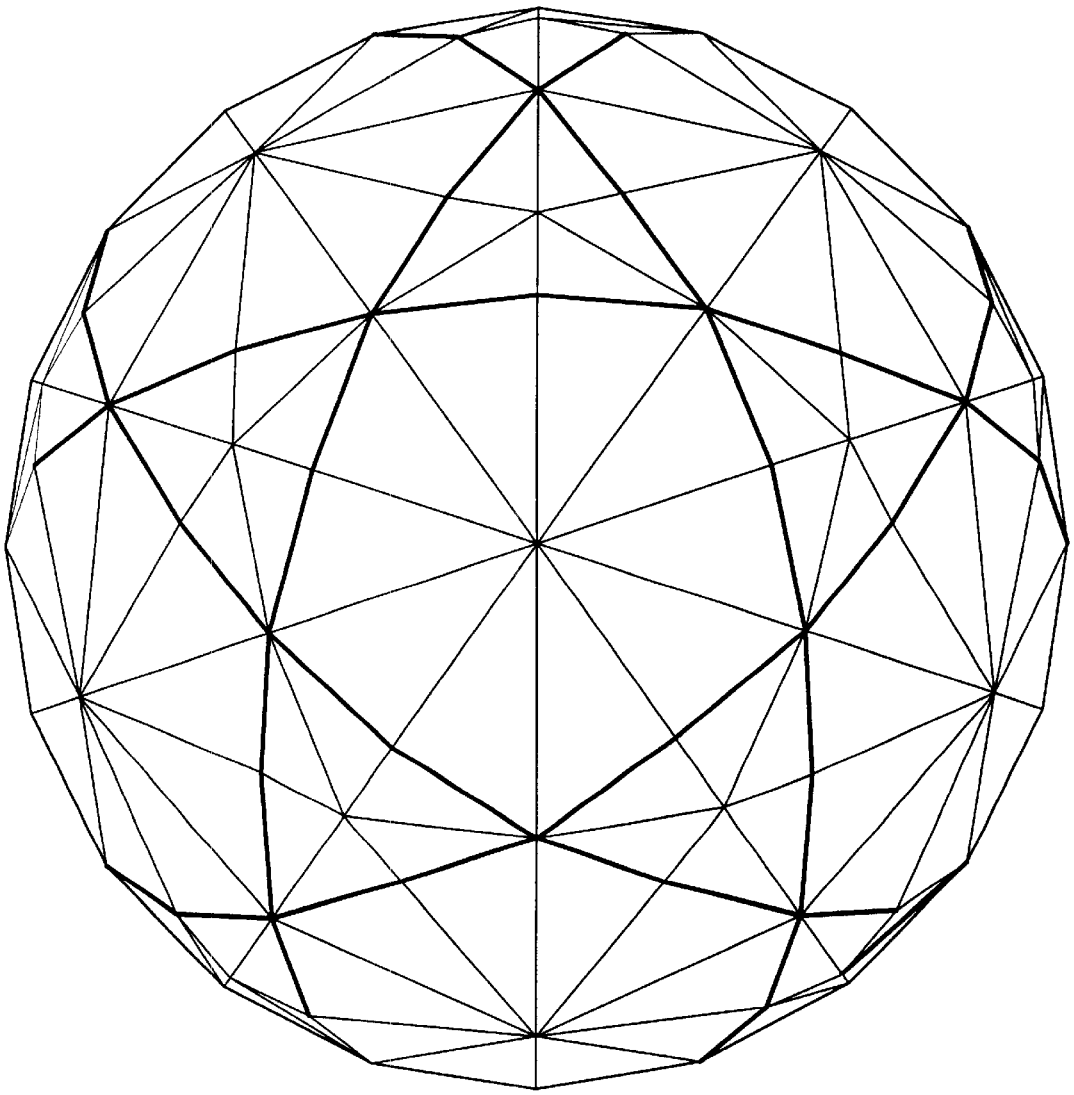
Figure 5A:
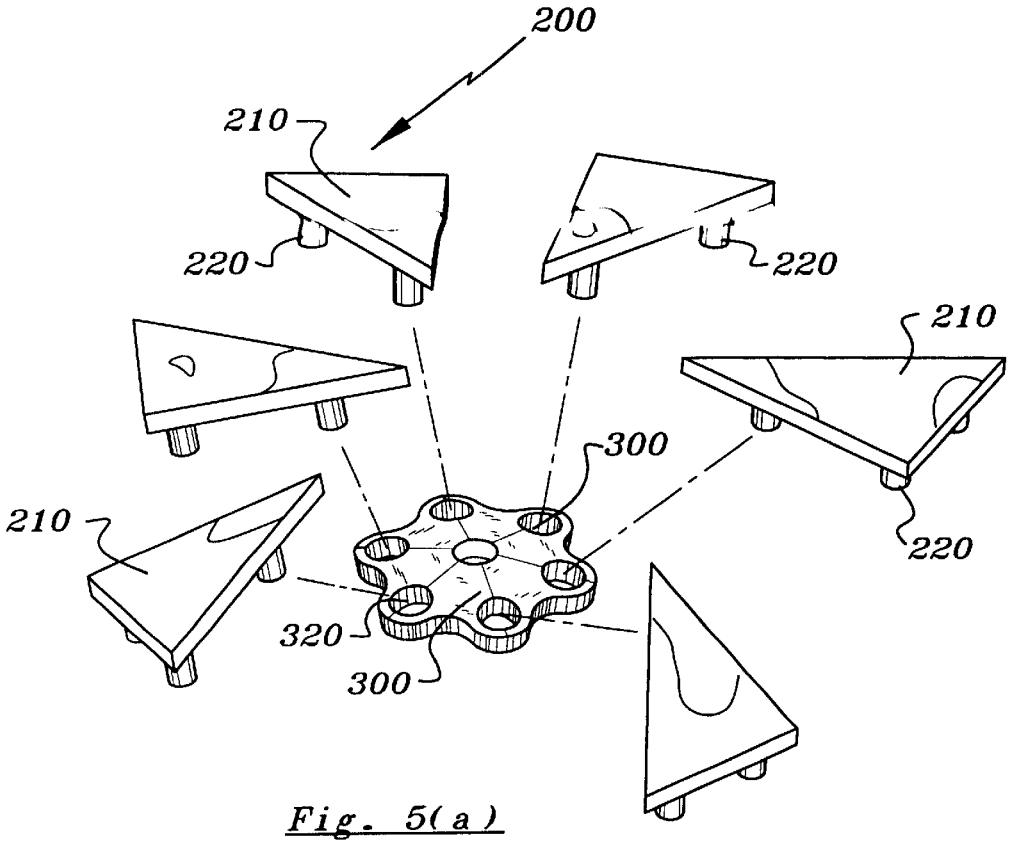
Figure 5A:
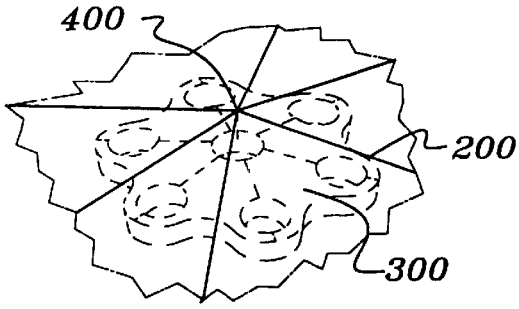

BRIEF DESCRIPTION OF THE DRAWINGS a) FIG. 1 is a 3 D isometric view of a polyhedron globe of 240 faces showing the northern hemisphere spread over 120 faces, which also shows the geographical significance of the polyhedron of 240 faces with respect to longitudinal and latitudinal information such as equator, meridian etc of a globe superimposed thereon.

b) FIG. 2 shows one half of the polyhedron of FIG. 1 but without the clutter of the geographical information.

c) FIG. 3 shows a plan view of a simpler polygon of only 32 faces.

d) FIG. 4 shows how a 240 face polyhedron is derived from a generic icosadodecahedron (32 faced) polygon wherein projected edges of the original 32'dron are shown in thicker heavy lines.

e) FIG. 5(*a*) shows a non-isometric perspective view of a plurality of triangular elements of the polyhedron globe with the inscribe-able face facing the viewer/reader.

f) FIG. 5(*b*) shows a plan view of vertex showing plurality of triangles over the perforated fixing lug member of FIG. 5(*a*) shown in dotted lines.

DETAILED DESCRIPTION OF THE PREFERRED EMBODIMENT

The polyhedron globe puzzle system 100 of this invention as shown in the various drawings wherein like numerals represent like parts throughout the several views, there is generally disclosed in FIG. 1 is a 3 D isometric view of a polyhedron globe 110 of 240 faces showing the northern hemisphere spread over 120 faces, which also shows the geographical significance of the polyhedron of 240 faces with respect to longitudinal and latitudinal information such as equators meridian etc of a globe superimposed thereon.

This design is for a three-dimensional assembly puzzle which, when correctly completed, becomes a generally spherical representation of the world. An embodiment of this globe is in the shape of a regular polyhedron composed of 240 flat scalene triangles 200. The pieces of the puzzle, on each of which a particular section of the world map 110 is inscribed, correspond to these faces.

This globe of FIG. 1 is inscribed on a regular dicosatetraconahedron. This is a polyhedron 150 composed of 240 scalene triangles 150, and is hereinafter referred to as a 240'dron. The 240'dron consists of 120 each of the two basic shapes of triangle. Each of these groups is divided evenly between 60 of the respective basic shape and 60 of its enantiamorph. All 4 shapes of triangular pieces 200 are scalene with different lengths and angles.

As the number of triangular pieces 200 increases the overall shape of the polyhedron 100 resembles a sphere. In theory if infinite number of triangles 200 are used then the polyhedron 100 becomes a perfect sphere and each scalene triangle become a right angled triangle.

FIG. 2 shows a 'quartet' of these four types of faces. For ease of comprehension the clutter of geography has been removed from this figure. This quartet is repeated over the whole surface of the 240'dron. The 240'dron has 360 edges of unequal length. The 240'dron is generated from a regular icosadodecahedron, which is a regular solid of 32 faces, twelve regular pentagons and twenty equilateral triangles. Pentagons in turn are comprised of scalene triangles.

FIG. 3 shows a plan view of a simpler polygon of only 32 faces, which has 60 uniform edges. The 240'dron 150 is generated by placing a node at the center of each of the 32 faces, and at the mid-points of all the edges of the 32'dron 120. These nodes 310 are then moved outward so as to lie on the circumsphere of the 32'dron. They are then joined, via new edges, to each other and to the adjacent original nodes of the 32'dron.

FIG. 4 shows how a 240 face polyhedron 150 is derived from a generic Icosadedecahedron (32 faced) polygon 120 wherein projected edges of the original 32'dron are drawn in heavy (thicker) lines.

FIG. 5 shows the underlying fixtures that support the polyhedron in proper position. More particularly FIG. 5(*a*) shows a non-isometric perspective view of a plurality of triangular elements of the polyhedron globe with the inscribeable face facing the viewer/reader and FIG. 5(*b*) shows a plan view of vertex showing a plurality of triangles over the perforated fixing lug member of FIG. 5(*a*) shown in dotted lines.

In the preferred embodiment the inventor employed a polyhedron globe puzzle system of 240 scalene triangles and means for interconnecting said 240 scalene triangles to form a generally spherical globe and wherein a world map is inscribed on the outside surfaces of said 240 scalene triangles and wherein every edge between any two adjacent triangles of said 240 scalene triangles represents a section of a Great Circle on the Earth's surface.

The interconnecting means employed a plurality of perforated lugs and matching studs connected to said 240 scalene triangles and wherein said 240 scalene triangles meet over one of said plurality of lugs and wherein plurality of said lugs are inter connected together to form said polyhedron globe including a means for gleaning geographical information from said polyhedron globe. In the best mode embodiment the inventor used four types of lugs 300, corresponding to the four different types of vertex 230 in the regular 240'dron, i.e. the ten-, eight-, six- and four-way junctions were used.

In an embodiment the inventor used 60 scalene triangles each of four different and interconnected then with plurality of lugs which are also of 4 different types corresponding to 10, 8, 6 and 4 way junctions. In the preferred embodiment the inventor inscribed the appropriate section of the world map on the outside (visible to the user) of each triangular segment. On the other side (inner side) of the triangular segment. Accordingly the inventor used studs 220 which snugly fit into corresponding perforated fixing lugs at every vertex 230 of the polyhedron 100. The lugs 300 incorporate shallow angle facets 350 so that each lug fits snugly under each of the triangular elements at the junction.

Lugs 300 were made out of some semi-rigid and resilient material to allow the studs 220 to be pressed home without the immediately falling out again. For building the globe manually most of the fixings can be secured by pressing them between finger and thumb.

The last piece, is push fixed from outside carefully so as not to dislodge the surrounding fixings. Correspondingly, in the dismantling process, the first piece would have to be extracted using some sort of externally applied device, such as a small suction cup, to get the process under way.

THEORY OF OPERATION

As shown in FIG. 1, due to the geometrical regularity of the 240'dron 150 its nodes 310 and edges can assume geographical significance when it is used to represent the world. An important property of the 240'dron is that its 360 edges form themselves into 21 circumscribing polygons which, when projected on to a concentric true sphere, become Great Circles.

This means that for any two points that lie on the same circumscribing polygon of the FIG. 1, the segment of polygon between those two points represents the shortest distance between them on the earth's surface.

If, as in FIG. 1, the North Pole is represented by the centroid node of one of the pentagons, the centroid of the opposite pentagon become the South Pole, and the five circumscribing polygons which intersect at these two poles together comprise 10 lines of longitude, at 36 degree intervals, between any chosen meridian (Zero degrees) and 180 degrees East/West.

A great circle may be defined as a circle on the surface of a sphere, such as the earth, that has a radius equal to the radius of the sphere, and whose center is also the sphere's center. The essential property of the great circle, that this invention exploits, is that the shortest distance between any two points on a sphere, as measured on the surface of that sphere, constitutes a segment of a great circle.

This is of critical geographical importance when looking at a World Globe and considering the distance between two remote points on the Earth's surface.

In the preferred embodiment the circumscribing polygon midway between the two pentagons, becomes the equator. All other nodes on the figure will represent a definite position of latitude and longitude.

The puzzle 100 may be repeatedly assembled and dismantled, starting and finishing with any piece. When assembled, the globe is virtually rigid, discrete, freely portable and independent of any external housing, bracketing or support. When dismantled, the pieces are packed away to occupy not much more space than a conventional jig-saw puzzle.

The operation and use of the polyhedron globe puzzle system of this invention is simple and even intuitive. Nonetheless the inventor recommends the following steps.

a) Select a vertex with corresponding triangles and push them into the matching lug of same number.

b) Continue building with additional triangular pieces using additional lugs as needed.

c) Push the last piece, from outside carefully so as not to dislodge the surrounding pieces or underlying fixtures.

The reverse process is used for dismantling. The first piece is extracted using some sort of externally applied device, such as a small suction cup, to get the process under way.

The inventor has given a non-limiting description of the oil changing system of this invention. Due to the simplicity and elegance of the design of this invention designing around it is very difficult if not impossible. Nonetheless many changes may be made to this design without deviating from the spirit of this invention. Examples of such contemplated variations include the following:

1. The shape and size of the various members and components may be modified.
2. The color, aesthetics and materials may be enhanced or varied.
3. The puzzle may be used for teaching other subjects and knowledge domains.
4. Additional complimentary and complementary functions and features may be added.
5. The globe may be filled or made solid.
6. A different means of joining the pieces together may be employed.
7. The polyhedron globe may be made perfectly spherical.

Other changes such as aesthetics and substitution of newer materials as they become available, which substantially perform the same function in substantially the same manner with substantially the same result without deviating from the spirit of the invention may be made.

Following is a listing of the components used in this embodiment arranged in ascending order of the reference numerals for ready reference of the reader.

100 =Polyhedron spherical globe generally
110 =Inscription on polyhedron globe
120=32 face polyhedron
150=240 face polyhedron
200 =Scalene triangular element
210 =Inscribe-able face of triangular element
220 =Stud member of triangular element
230 =Vertex of triangular member
240 =Edges of triangular elements
300 =Perforated Fixing lug
320 =Triangular element lug receptacle
310 =Node
330 =Center hole in the perforated fixing lug member
350 =Shallow angled edge of perforated lug member
400 =Multiple junction vertex Definitions and Acronyms A great care has been taken to use words with their conventional dictionary definitions. Following definitions are included here for clarification.

Dicosatetraconahedron=A polyhedron with 240 faces

Globe=A sphere inscribed with a map

Great Circle=A circle on the surface of a sphere, such as the Earth, that has a radius equal to the radius of the sphere, and whose center is also the sphere's center.

Icosadodecahedron=A polyhedron with 32 faces

Integrated=Combination of entities to act as 1

Interface=Junction of two dissimilar entities

Isosceles=having two equal sides

Node=A point on the surface of a polyhedron where edges meet. In a regular normal polyhedron it is the point farthest from the center.

Polyhedron=A three dimensional multi-faceted spherical member

Scalene Triangle=Triangle with 3 sides of different length and angles

Symmetrical=The shape of an object of integrated entity which can be divided into two along some axis through the object or the integrated entity such that the two halves form mirror image of each other.

Vertex=A point farthest from the base for example of an isosceles triangle.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefor contemplated that the appended claim(s) cover any such modifications, embodiments as fall within the true scope of this invention.

The inventor claims:

1. A polyhedron globe educational system comprising:

a) a plurality of 240 scalene triangles;

b) means for interconnecting said plurality of scalene triangles, connected to form a generally spherical globe;

c) a world map inscribed on said generally spherical globe;

d) wherein the edges of said plurality of scalene triangles represent a section of a Great Circle of said world map on said globe;

e) said means for interconnecting said 240 scalene triangles comprise a plurality of perforated lugs and matching studs connected to said 240 scalene triangles and wherein said 240 scalene triangles meet over one of said plurality of lugs and wherein plurality of said lugs are inter connected together to form said polyhedron globe including a means for gleaning geographical information from said polyhedron globe; and f) wherein said 240 scalene triangles are 60 each of four different types interconnected with said plurality of lugs which are also of 4 different types corresponding to 10, 8, 6 and 4 way junctions.

* * * * *